United States Patent [19]

Müller et al.

[11] 4,417,225

[45] Nov. 22, 1983

[54] FLAT FUSE AND PROCESS FOR PRODUCTION THEREOF

[75] Inventors: Wulf Müller; Manfred Kaiser, both of Wuppertal, Fed. Rep. of Germany

[73] Assignee: Grote & Hartmann GmbH & Co. KG, Wuppertal, Fed. Rep. of Germany

[21] Appl. No.: 366,766

[22] Filed: Apr. 8, 1982

[30] Foreign Application Priority Data

Apr. 16, 1981 [DE] Fed. Rep. of Germany ..... 3115435

[51] Int. Cl.[3] ..... H01H 85/02

[52] U.S. Cl. ..... 337/198; 337/295

[58] Field of Search ..... 337/198, 201, 206, 251, 337/252, 260, 261, 262, 264, 290, 295

[56] References Cited

U.S. PATENT DOCUMENTS

| | | | |
|---|---|---|---|
| 3,909,767 | 9/1975 | Williamson et al. | 337/264 |
| 4,164,725 | 8/1979 | Wiebe | 337/198 |
| 4,224,592 | 9/1980 | Urani et al. | 337/260 X |

*Primary Examiner*—George Harris

*Attorney, Agent, or Firm*—Goodman & Teitelbaum

[57] ABSTRACT

A flat fuse including two plug blades arranged next to one another in the same plane, being spaced from one another. The plug blades are fabricated from stamped sheet metal parts, the plug zones of which extend, in each case, rearwardly in a one piece construction into current-conducting straps. Between the straps, there is arranged a fuse fusion wire which is fastened to the straps. The current-conducting straps and the fusion conductor are surrounded by and enclosed in a plastic casing. The fuse fusion wire includes a copper wire with a silver sheathing, and the current-conducting straps as well as the plug blades are fabricated from brass, in which arrangement at least the current-conducting straps, but preferably also the plug blades, are superficially tinned. The fusion conductor is welded, in each case, to a flat side of the current-conducting straps.

13 Claims, 6 Drawing Figures

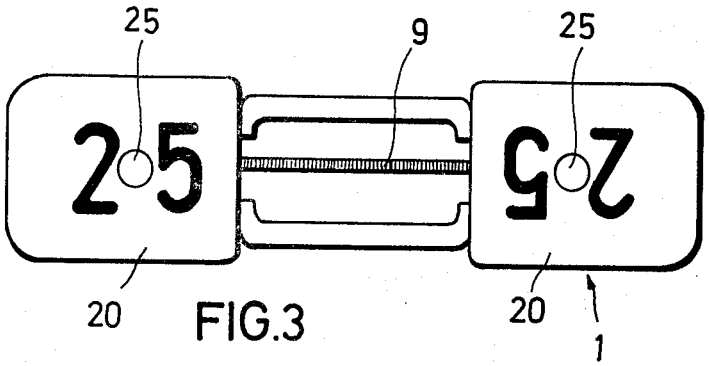
FIG.3
FIG.4
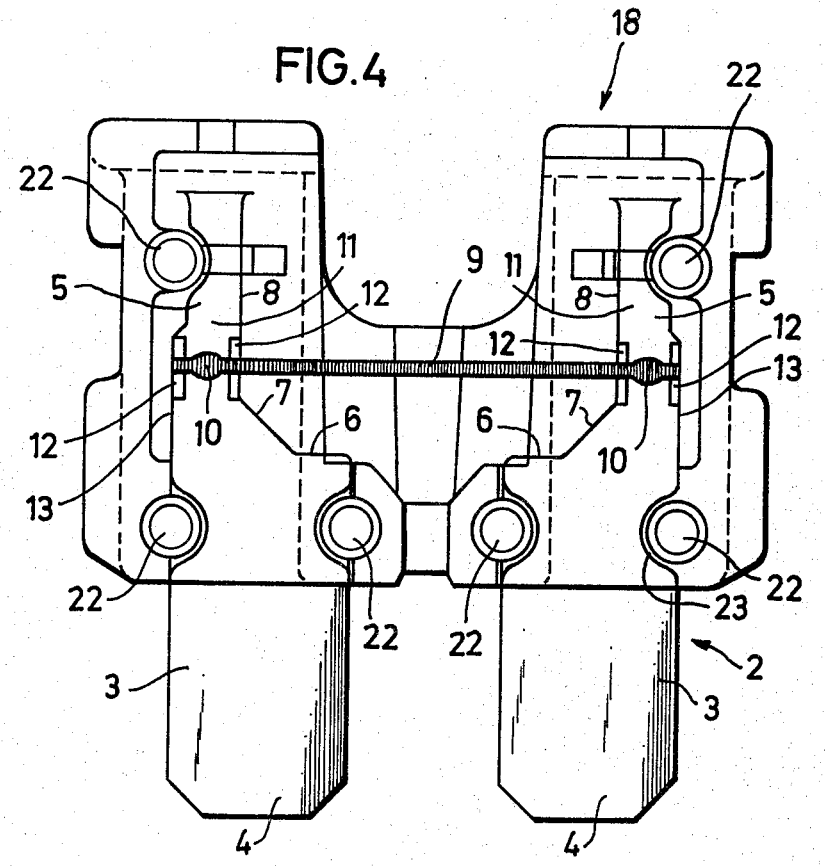

FLAT FUSE AND PROCESS FOR PRODUCTION THEREOF

The invention relates to a pluggable electrical flat fuse in miniature form, this type of flat fuse being described, for example, in German unexamined patent specification OS No. 25 00 364.

As a rule, such fuses include plug blades of standardized dimensions, the plug blades being stamped sheet metal parts which are spaced from one another. The plugging zones of the plug blades, in each case, extend rearwardly in one piece into current-conducting straps, with the fusion conductor being arranged between the straps. The current-conducting straps and the fusion conductor are enclosed in a plastic casing.

As disclosed in German unexamined patent specification OS No. 28 33 046, it is a known practice to use a fusion wire for the fusion conductor, and inter alia to solder the wire to the current-conducting straps. For the wire material, there is mainly proposed to use a tin-lead wire. For the current-conducting straps and the plug blades there is indicated, according to the disclosure to use spring brass on which the wire is soldered, the wire being clamped between spring elements of the current-conducting straps. However, the soldering on of the fusion wires involves considerable disadvantages. Because of the attacking action of the soldering flux agent, as well as the efflorescences and foulings, the electrical values of the fuse can be uncontrollably altered. In particular, the foulings lead to so-called cold soldering places which impair the characteristic values of the fuse.

An object of the present invention is, in a flat fuse of the type described, to arrange the fusion wire mechanically firm and to define the fusion wire electrically without the characteristic curve of the wire being impaired.

This object is achieved, according to the present invention, by means of the fusion conductor including a copper wire with a silver sheathing, and the current-conducting straps as well as the plug blades being fabricated from brass, in which arrangement at least the current-conducting straps, preferably however also the plug blades, are superficially tinned. The fusion conductor is welded, in each case, on a flat side of the current-conducting straps.

German utility model GM No. 66 05 723 teaches of a flat fuse in which are arranged conduction paths of metal bands on an insulating flat base body, and between the bands is disposed a fusion wire. On the one conduction path, the wire is welded, and on the other conduction path, the wire is soldered. No statement is made about the type of materials.

Despite these teachings in the state of the prior art, heretofore no miniature flat fuse has appeared on the market in which a fusion wire is welded onto flat plug blades or flat current-conducting straps. However, this fact is not surprising, because the metals ordinarily used for the flat plug elements and the fusion wire are not weldable with one another in such a way that electrically defined values can be ensured for the welding places. Thus, despite the state of the prior art mentioned, it was not a directly obvious idea to try the welding of the fusion wire, although, as is well known, at least with respect to the mechanical strength for the connection of parts, welding offers advantages.

According to the present invention, in order to achieve the object posed, a selection of the metals is made which were not used in earlier devices nor thought of in the state of the prior art. In particular, the tinning of the surface of the stamped sheet metal parts has produced the surprising effect that a faultless welding is feasible without loss of the fusion wire characteristic curve. As yet, there is no explanation for this effect of the surface tinning. There was not directly present in the prior art, any occasion for tinning.

For welding on the fusion wire in the present invention, there is used a miniature part welding technique, known per se, the wire being applied on both sides by fine-point welding. Even with this welding technique, heretofore, the possibility of directly welding with one another the most important fuse metals of the present invention, namely brass and copper, was not known.

The use according to the present invention of tinned brass and silvered copper wire, further offers the advantage that the coatings to the greatest possible extent prevent corrosion, so that the electrical values of the fuse remain preserved over a long period of time.

With the above and additional objects and advantages in view, as will hereinafter appear, this invention comprises the devices, combinations and arrangements of parts hereinafter described by way of example, and illustrated in the accompanying drawings, of a preferred embodiment in which:

FIG. 3 is a top view thereof;

FIG. 4 is a front view of an inner portion of the lower casing half-shell of the fuse, showing a fuse element installed therein;

In the various figures of the drawings, like reference characters designate like parts.

Figure 1:
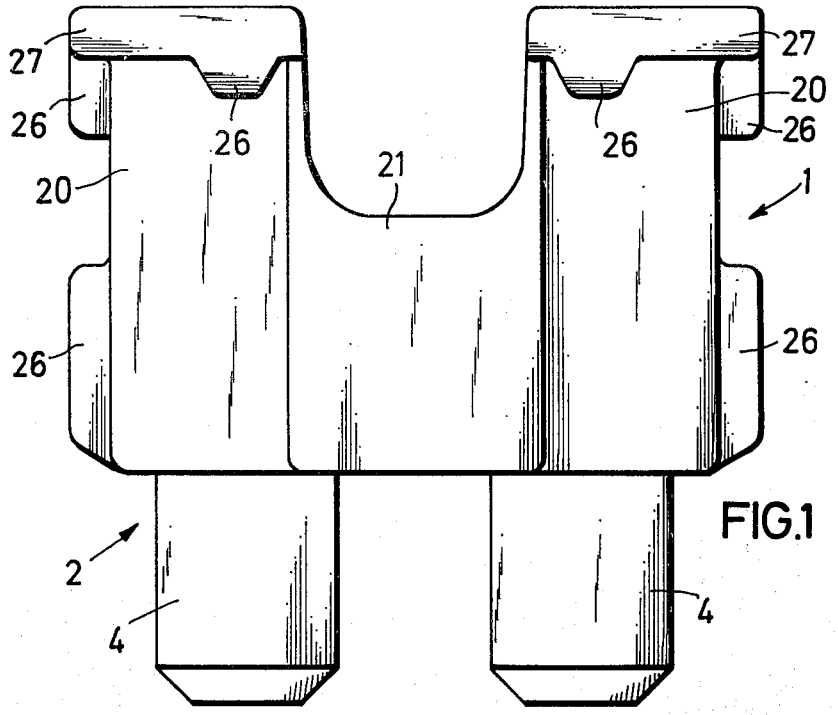
FIG. 1 is a front view of the flat fuse in accordance with the present invention.
Figure 2:
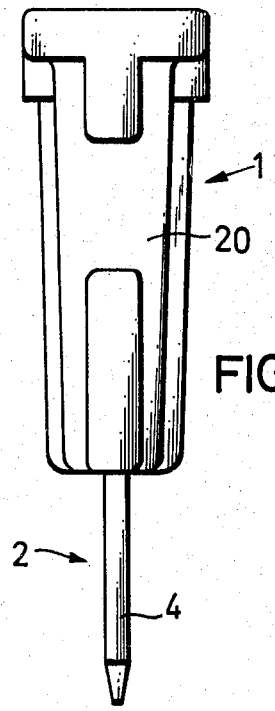
FIG. 2 is a side view of the flat fuse.

Referring now to the drawings, FIGS. 1, 2 and 3 show a flat fuse, according to the present invention, including a casing 1 and a fuse element 2. The casing 1 is preferably fabricated from a plastic material.

The fuse element 2 includes two spaced-apart stamped sheet metal parts 3 arranged adjacent to one another with the spacing therebetween, being disposed in the same plane in mirror image arrangement to one another, whereby the stamped parts 3 have a like form as shown in FIG. 4.

Each stamped sheet metal part 3 is functionally subdivided into a plug blade 4, which extends upwardly in a one piece construction into a current-conducting strap or tab 5. Preferably, the straps 5 are constructed narrower than the plug blades, having a cut edge 6 running inwardly from the plug blade edge in each case, then extending into an obliquely upward-leading cut edge 7, and the latter extending into a perpendicular cut edge 8 on each strap 5. This formation of the straps 5 provides a relatively wide open spacing between the straps 5, so that a sufficiently wide space is available for a relatively long fusion wire 9. The wide distance between the straps 5 facilitates, moreover, the welding on of the fusion wire 9.

The fusion wire 9 is welded, in each case on a point-welding place 10, to the flat side 11 of the straps 5. Preferably, in the zone of the welding place 10, the particular cut edge 8, and/or opposite cut edge 13 of the straps 5, is engaged by impression, so that there results the indented surfaces 12 running obliquely to the respective edge. By this spatial form, it is achieved that the edges 13 and 8 in the handling of the fuse element, for example during the installation thereof in the casing, do not have a notching or incensing effect on the fusion wire 9, and thereby do not possibly impair its characteristic curve.

The fusion wire 9 is a copper wire with a silver sheathing, and the current-conducting straps 5 as well as the plug blades 4 are fabricated from brass, in which arrangement at least the current-conducting straps, preferably however also the plug blades, are superficially tinned.

Figure 6:
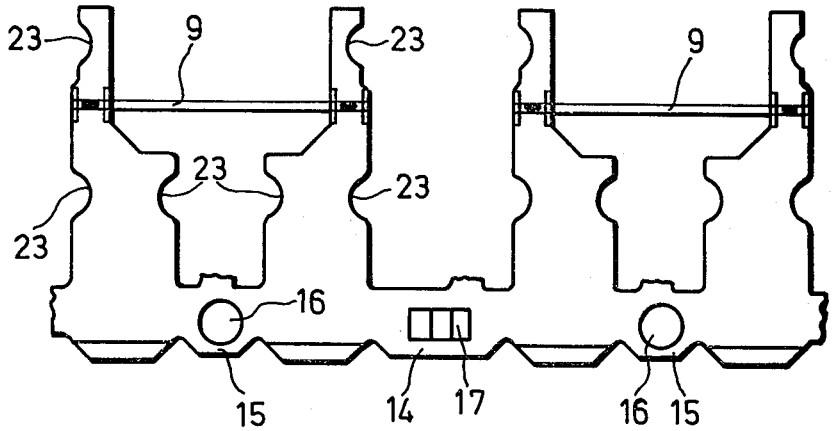
FIG. 6 is a front view of fuse elements attached on metal strips.

The production of the fuse element 2 occurs automatically, according to the present invention. First from tinned sheet metal strips, there are stamped out the contours of the parts 3. The parts 3 are arranged in a mirror image pattern to one another, so that in each case two stamped sheet metal parts 3 are used for one fuse element. In FIG. 6, in the interest of better showing, only two fuse elements are depicted, which communicate with one another over a material strap or tab strip 14 in the zone of the contact blades. Also, the associated contact blades of each fuse element are joined with one another by a material strap or tab strip 15. In this form, the pre-product of the fuse element is introduced into the welding machine (not shown), the transport holes 16 in the material straps 15 and the pushed-through guide lugs 17 in the material straps 14, being suitably used by corresponding conveyance elements. In the welding machine, the wire to be welded is fed in endlessly and is then welded on. Thereupon, the unnecessary wire parts of the endless wire, which are disposed between the fuse elements blanks, are cut away. The materials strips 14 and 15 are then continuously separated off. Then, immediately in the process, the casing is automatically emplaced on each liberated fuse element. This procedure is very economical and brings about low production costs for the new flat fuse according to the present invention.

Figure 5:
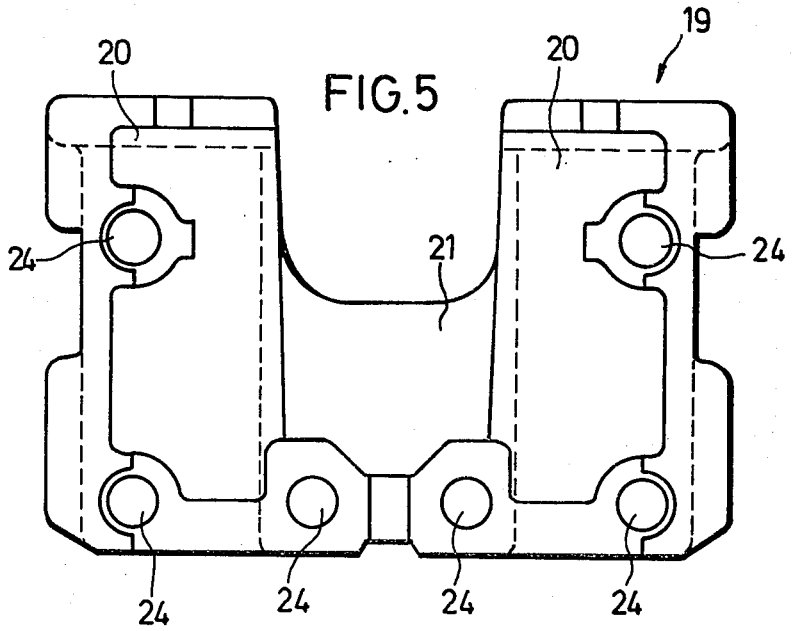
FIG. 5 is a front view of an inner portion of the upper casing half-shell.

The casing 1 includes two halves, namely the lower casing half-shell 18 as shown in FIG. 4, and the other upper casing half-shell 19 as shown in FIG. 5. The two casing half-shells are U-shaped in construction as shown in the elevational views of the drawings. Between the two shanks or legs 20 thereof, the current-conducting straps 5 and, in part, also the contact blades 4, are clamped. The strap or bight 21 thereof receives the fusion wire 9 freely therethrough, the bight 21 being open at the upper portion thereof, so that the fusion wire 9 is visiable, as shown in FIG. 3. In the remaining round about zones, the casing is virtually closed.

The fixed position of the fuse element 2 in the casing 1 is provided by the pins 22, which are arranged in the lower casing half-shell 18. These pins are distributed along the outer border of the casing relative to the stamped sheet metal parts 3, in such a way that the cut edges 13 of the stamped sheet metal parts can abut against the pins 22. Preferably, for this abutment, there are further provided semicircular centering recesses 23 in the stamped sheet metal parts 3, as depicted in FIGS. 4 and 6.

The pins 22 are engaged in corresponding holes 24 in the upper casing half-shell 19, the two half-shells being securely joined together in the zone of the pins 22.

The current-conducting straps 5 extend about up to the free ends of the shanks or legs 20, the free ends having openings 25 therein through which each respective strap can be contacted for testing purposes.

On the casing 1, there are further provided laterally extending guide straps or tabs 26, as shown in FIG. 1, which serve for the guidance and positioning of the flat fuse in a plug strip (not shown). Moreover, in the upper end zone of each of the shanks or legs 20, there is arranged a surrounding grip strip 27.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A flat fuse comprising two plug blades adjacently spaced from one another in a plane, said plug blades being stamped sheet metal parts, plug zones of said plug blades extending rearwardly in a one piece construction into adjacently spaced current-conducting straps, a fuse fusion element being arranged between said straps and being secured to said straps, said current-conducting straps and said fusion element being surrounded and enclosed by a plastic casing, said fusion element including a copper wire provided with a silver sheathing, said current-conducting straps and said plug blades being fabricated from brass, at least said current-conducting straps being superficially tinned, and said fusion element being welded in each case to a flat side of said current-conducting straps.

2. A flat fuse according to claim 1, wherein said plug blades are also superficially tinned.

3. A flat fuse according to claim 1, wherein said current-conducting straps are constructed narrower than said plug blades so that the spacing between said adjacent current-conducting straps is greater than the spacing between said adjacent plug blades.

4. A flat fuse according to claim 3, wherein a cut edge in a transition zone between said plug blade and said current-conducting strap of each stamped sheet metal part runs inwardly from an edge of said plug blade, and extends into an obliquely upward-leading edge and finally extends into a perpendicular cut edge of said strap.

5. A flat fuse according to claim 1, wherein said fusion wire is welded in each case at a spot welding place on a flat side of said current-conducting straps.

6. A flat fuse according to claim 5, wherein at least one respective cut edge of said current-conducting straps is engaged in the zone of said welding place by impression to provide an indented surface running obliquely to said respective cut edge.

7. Flat fuse according to claim 1, wherein said casing includes two halves to provide a lower casing half-shell and an upper casing half-shell, said two casing half-shells each having a pair of legs connected by a bight portion to define a U-shaped construction, said current-conducting straps and, in part, also said plug blades are clamped between associated legs, said fusion wire extending freely through said bight portion, and said bight portion being open at an upper end thereof.

8. A flat fuse according to claim 7, wherein pins are arranged in said lower casing half-shell for securely positioning said stamped parts, said pins being distributed along an outer board of said casing relative to said stamped sheet metal parts, cut edges of said stamped sheet metal parts abutting against said pins in closed condition of said casing.

9. A flat fuse according to claim 8, wherein semicircular centering recesses are provided in said stamped sheet metal parts to grip around said pins.

10. A flat fuse according to claim 8, wherein said pins engage through holes in said upper casing half-shell, said two half-shells being securely joined with one another in the zone of said pins.

11. A flat fuse according to claims 7, wherein said current-conducting straps extend about to a free end of said legs, a hole being provided in each free end of said legs through which a respective strap can be contacted for testing purposes.

12. A flat fuse according to claim 7, wherein guide straps are provided laterally on said casing, said guide straps running parallel to said plug blades, and a surrounding grip strip is provided in an upper end zone of said legs.

13. Process for production of a flat fuse comprising stamping out contours of sheet metal parts from a tinned brass sheet strip, arranging in each case two stamped sheet metal parts belonging to a fuse element in a mirror image arrangement to one another so that associated contact blades of each fuse element are joined with one another by first material strap and each fuse elemlent communicates with one another over a second material strap in a zone of adjacent contact blades of different fuse elements, introducing the fuse element arrangements into a welding machine with transport holes in the first material straps and pressed-through guide lugs in the second material straps being utilized expediously by corresponding transport elements, feeding an endless fusion wire into the welding machine, welding the wire on each fuse element, cutting away the wire parts not required disposed between the different fuse elements, then continuously separating the first and second material straps from the fuse elements, and then immediately automatically setting casing parts in place on each liberated fuse element and joining said casing parts with one another.

* * * * *